United States Patent [19]

Burns

[11] 4,126,346

[45] Nov. 21, 1978

[54] SCOOP

[76] Inventor: Johnson R. Burns, 502 Roosevelt Rd., Pittsburgh, Pa. 15237

[21] Appl. No.: 881,904

[22] Filed: Feb. 27, 1978

Related U.S. Application Data

[63] Continuation of Ser. No. 757,606, Jan. 7, 1977, abandoned.

[51] Int. Cl.[2] ..... A47F 13/08

[52] U.S. Cl. ..... 294/55

[58] Field of Search ..... 294/49, 55; D7/104; 15/257.3; 16/110 R; 53/390; 141/108, 109, 319, 331, 334, 358, 391; 209/418

[56] References Cited

U.S. PATENT DOCUMENTS

| | | | |
|---|---|---|---|
| D. 30,292 | 2/1899 | Seble | D7/104 |
| D. 147,459 | 9/1947 | Kloth | 294/55 X |
| D. 176,658 | 1/1956 | Emerson | D7/104 |
| 440,059 | 11/1890 | Quigley | 294/55 |
| 528,607 | 11/1894 | Peat | 294/55 |
| 741,195 | 10/1903 | Voelker | 294/55 |
| 952,313 | 3/1910 | Droz | 141/334 X |
| 1,128,183 | 2/1915 | Petrie | 141/108 |
| 2,687,245 | 8/1954 | Allston et al. | 141/319 |
| 3,255,570 | 6/1966 | Weimer | 141/108 X |
| 3,737,944 | 6/1973 | Szabo et al. | 16/110 R |

*Primary Examiner*—Johnny D. Cherry
*Attorney, Agent, or Firm*—Buell, Blenko & Ziesenheim

[57] ABSTRACT

A scoop for sand, grain, corn and the like comprising a length of open tubing or pipe of light-weight material, such as plastic material, the ends of which are oppositely slanted at an angle with respect to the longitudinal axis of the tubing. A hole is located in the wall of the tubing symmetrical with respect to a line longitudinally connecting the end openings at the shortest distance therebetween. A handle of tubular plastic material is secured to the wall of the tubing in longitudinal straddling relation to the hole, whereby the fingers grasping the handle may extend through the hole and stresses in the wall of the tubing are minimized.

5 Claims, 5 Drawing Figures

SCOOP

This is a continuation of application Ser. No. 757,606, filed Jan. 7, 1977, now abandoned.

This invention relates to scoops for commodities, such as sand, grain and the like, of the type wherein the commodity scooped may enter and leave the scoop at opposite ends with a unidirectional motion of the scoop accompanied by a change of inclination with respect to the horizontal.

Scoops of this general type are known, such as those shown in U.S. Pat. No. 147,459, U.S. Pat. Nos. 264,295, 528,607, 741,195 and 3,255,570. The scoops in these patents are generally of channel shape with a laterally projecting handle. The design patent and U.S. Pat. No. 3,255,570 are for handling foods, such as popcorn, candies, peanuts and french fried (segmented) potatoes. The scoop of U.S. Pat. No. 741,195 is for handling grains. U.S. Pat. Nos. 264,295 and 528,607 are so-called tile scoops for making ditches to receive drainage tiles.

I have found that existing scoops, such as those in the prior art, were not suitable for certain purposes, such as shoveling sand for making sand molds in foundries. The capacity of existing scoops was wholly inadequate and the scoops themselves were awkward and tiring to handle.

It is the object of the invention therefore to provide a scoop of the general type described but which has advantages over existing scoops in the way of capacity, ease of handling and in serviceability. Incidentally, I have also found that my new and improved scoop lends itself to simplicity of manufacture and low-cost of production.

The invention comprises a scoop made of a suitable length of light-weight tubular material, such as plastic pipe, the ends of which are slanted oppositely at an angle to the longitudinal axis of the pipe. A hole is cut in the wall of the pipe symmetrically with respect to a longitudinal line representing the shortest distance between the end openings and a handle of semi-rigid tubular material is attached to the wall of the pipe in longitudinal straddling relation to the hole.

I have found that a scoop made in the manner aforedescribed, is stronger, more serviceable and easier to use than one in which the wall of the scoop does not have a hole between the end openings and is provided with an outwardly extending C-type handle attached thereto. Moreover, my scoop possesses the novel advantage of automatic return to an upright position in which the handle is at the top.

A preferrred embodiment of the invention is described hereafter in connection with the accompanying drawings, wherein.

Figure 1:
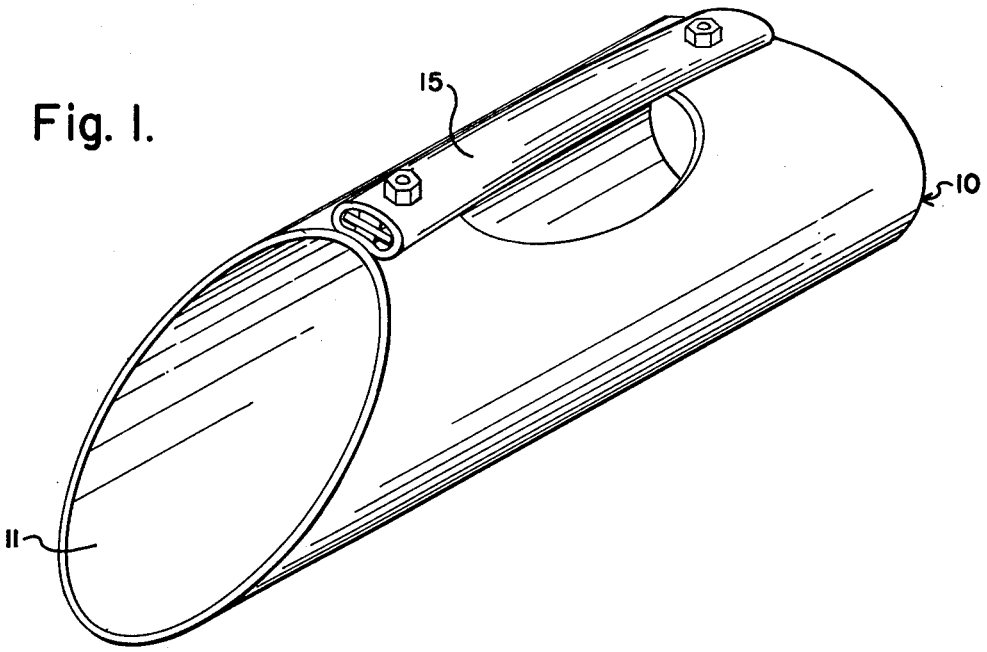
FIG. 1 is a perspective view of the invention.
Figure 5:
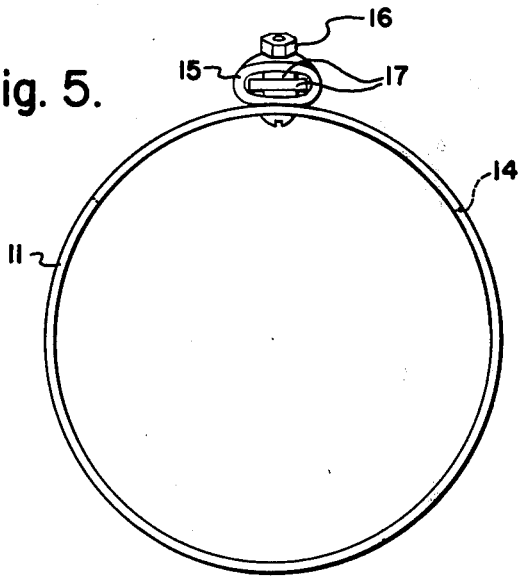
FIG. 5 is an end view of the scoop shown in FIG. 2.
Figure 3:
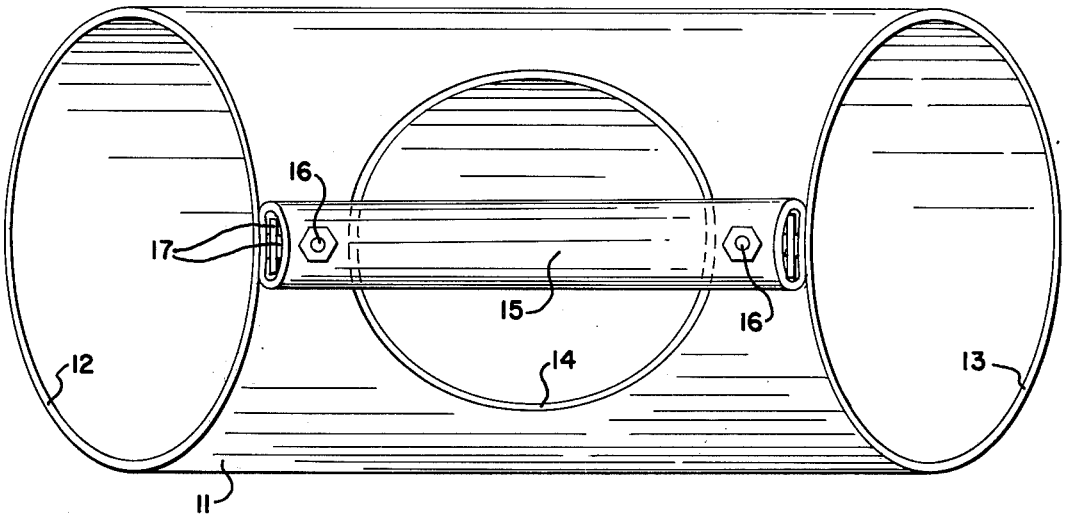
FIG. 3 is a top plan view of the scoop shown in FIG. 2.
Figure 2:
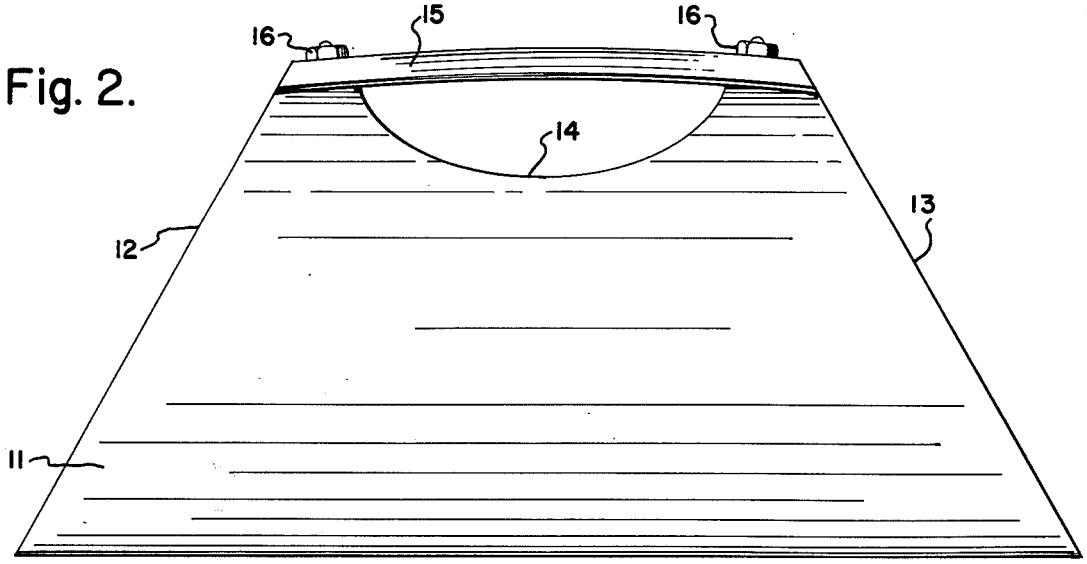
FIG. 2 is a side elevation view of the scoop shown in FIG. 1.
Figure 4:
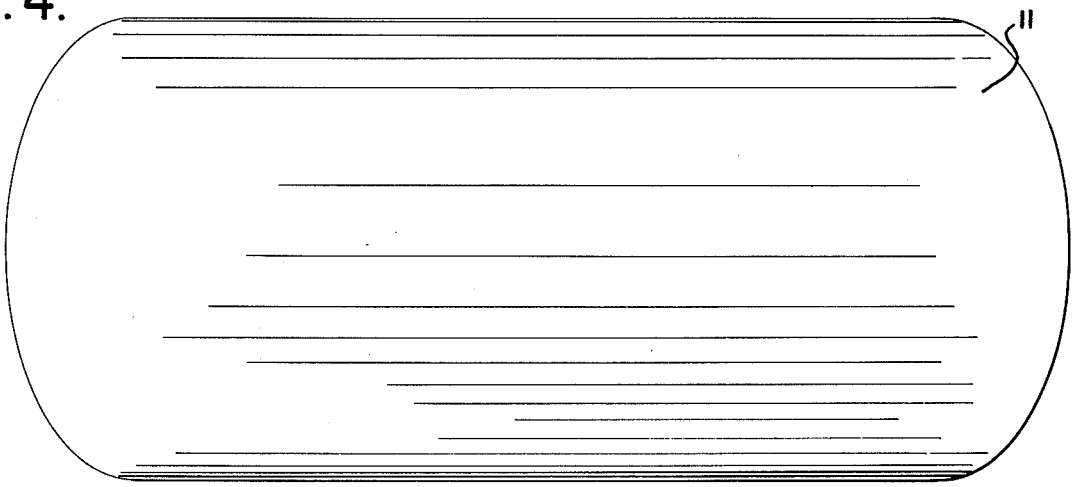
FIG. 4 is a bottom view of the scoop shown in FIG. 2.

Referring to the drawings, the embodiment of a scoop 10 shown therein, comprises a suitable length (e.g. 14 inches) of tubular material, such as plastic pipe 11. Plastic pipe of approximately 6 inches in diameter has been found to be quite suitable, as such pipe is a standard product readily obtainable and is of relatively low cost. Pipe of other light-weight material, plastic or metal, may be employed. Moreover, it is not required to limit the pipe to circular cross-section, as other cross-sectional configurations may be employed.

The opposite ends or end surfaces 12 and 13 of the scoop are made by cutting the pipe in two places at the same but oppositely inclined angles to the longitudinal axis of the pipe, while in a fixed position. An angle of 60° is preferred but any angle in the range of 45° to 75° to the longitudinal axis may be employed. The wall thickness of the pipe 11 may be of the order of one-eighth of an inch. When viewed perpendicularly to the plane of the opposite end surfaces, the wall thickness forms opposite end surfaces 12 and 13 having the same elliptical contour.

An opening or hole 14, preferably of circular or elliptical contour, is now cut through the wall of the pipe at the section of the pipe of shortest length joining the opposite end openings bordered by the end surfaces 12 and 13.

A handle 15, which may be made of a suitable length of semi-rigid plastic pipe or tubing is now attached to the wall of the pipe in longitudinally straddling relation to the hole. Handle 15 may be attached at opposite ends thereof to the sections of the pipe wall between the hole 14 and the opposite ends 12 and 13, as by bolts and nuts 16 of nylon or other material. If desired, other attachment means for the handle may be provided.

To provide additional rigidity to the handle 15, reenforcing strips 17 of plastic or other material may be provided within the pipe or tubular material constituting the handle. The opposite ends of the handle are cut off at an angle to coincide with the plane of the elliptical end surfaces 12 and 13.

In use, the workman grasps the handle 15 so that the fingers encircle the handle within the opening 14 in the wall of the scoop. With a short movement into a pile of properly prepared sand or the like, the workman can substantially fill the scoop, the quantity being at least equivalent to that held by a shovel. By changing the inclination of the axis of the scoop, the sand or other commodity may then be readily discharged and deposited in a mold or other receiver with a minimum expenditure of effort.

Experience and use of my improved scoop has demonstrated that it is seviceable and functionally efficient. Moreover, due to the manner in which the handle is attached closely to the wall of the scoop, stresses created in the pipe wall of the scoop under use are minimal and breakage or cracking is almost entirely avoided. It has been found also that the angular or slanted ends on the tubular or pipe body of the scoop minimizes the effort to enter a pile of material to be scooped such as sand or grain. Also, by reason of the fact that the center of gravity of my scoop is below the longitudinal axis, the scoop automatically rolls to an upright position in which the handle is at the top, when the scoop is placed on a horizontal plane surface.

I claim:

1. A scoop for sand, grain and the like comprising a tubular member having elliptical end surfaces which are slanted oppositely with respect to the longitudinal axis of the tubular member, the wall of said tubular member between the end surfaces having a circular opening therein, and a handle member attached to the wall of said tubular member at diametrically opposite sides of said opening and extending longitudinally in straddling relation across said opening and in close parallel relation to the wall of the tubular member.

2. A scoop according to claim 1, wherein said oppositely slanted elliptical end surfaces are formed by cutting the tubular member through at substantially equal angles to the longitudinal axis of the tubular member.

3. A scoop according to claim 1, wherein the said circular opening in the wall of the tubular member extends symmetrically to opposite sides of the shortest line joining the elliptical end surfaces of said tubular member.

4. A scoop for sand, grain and the like comprising a tubular member having end surfaces which are slanted oppositely with respect to the longitudinal axis of the tubular member, the wall of said tubular member between the end surfaces having a circular opening therein, and a handle member attached to the wall of said tubular member on diametrically opposite sides of said opening and extending longitudinally across said circular opening, said handle member being a uniform diameter tube of flexible plastic material flattened to an elliptical cross section.

5. A scoop for sand, grain and the like comprising a tubular member having end surfaces which are slanted oppositely with respect to the longitudinal axis of the tubular member, the wall of said tubular member between the end surfaces having an opening therein, and a handle member attached closely to the wall of said tubular member and extending longitudinally in straddling relation to said opening, said handle member comprising a tube of flexible plastic material, and a plurality of flat reenforcing strips of plastic material coextensive in length with said tube and disposed tightly within said tube, with the ends of the said tube and strips cut off at an angle to coincide respectively with the plane of the corresponding end surfaces of the tubular member.

* * * * *